US012123130B2

(12) United States Patent
Oshima et al.

(10) Patent No.: US 12,123,130 B2
(45) Date of Patent: Oct. 22, 2024

(54) TREATMENT AGENT FOR ELASTIC FIBERS, AND ELASTIC FIBER

(71) Applicant: TAKEMOTO YUSHI KABUSHIKI KAISHA, Aichi-ken (JP)

(72) Inventors: Keiichiro Oshima, Gamagori (JP); Jun Ito, Gamagori (JP); Takeshi Nishigawa, Gamagori (JP)

(73) Assignee: TAKEMOTO YUSHI KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 18/024,802

(22) PCT Filed: Sep. 6, 2021

(86) PCT No.: PCT/JP2021/032670
§ 371 (c)(1),
(2) Date: Mar. 6, 2023

(87) PCT Pub. No.: WO2022/050410
PCT Pub. Date: Mar. 10, 2022

(65) Prior Publication Data

US 2023/0265604 A1 Aug. 24, 2023

(30) Foreign Application Priority Data

Sep. 7, 2020 (JP) ..... 2020-149963

(51) Int. Cl.
*D06M 13/292* (2006.01)
*D06M 13/144* (2006.01)
*D06M 13/268* (2006.01)
*D06M 101/38* (2006.01)

(52) U.S. Cl.
CPC ..... *D06M 13/292* (2013.01); *D06M 13/144* (2013.01); *D06M 13/268* (2013.01); *D06M 2101/38* (2013.01); *D06M 2200/40* (2013.01)

(58) Field of Classification Search
CPC ..... D06M 13/292
See application file for complete search history.

(56) References Cited

U.S. PATENT DOCUMENTS 4,816,336 A * 3/1989 Allou, Jr. ..... D06M 13/463 252/8.84
5,491,026 A * 2/1996 Mudge ..... D06M 13/295 252/8.61

FOREIGN PATENT DOCUMENTS

| | | | | |
|---|---|---|---|---|
| JP | 2017-025438 A | | 2/2017 | |
| JP | 2017-110319 A | | 6/2017 | |
| JP | 2017-203222 A | | 11/2017 | |
| JP | 2018-127727 A | | 8/2018 | |
| JP | 2018159163 A | * | 10/2018 | |
| JP | 2019-183349 A | | 10/2019 | |
| WO | WO-2015125753 A1 | * | 8/2015 | ..... C08K 5/17 |
| WO | WO 2016/129357 A1 | | 8/2016 | |

OTHER PUBLICATIONS

Yamauchi et al. English machine translation of Intl. Pub. No. WO 2015125753 A1. (Year: 2015).*
Nakagawa et al. English machine translation of JP 2018159163 A. (Year: 2018).*
Korean Request for the Submission of an Opinion dated May 22, 2023, in connection with Korean Application No. 10-2023-7010003.
International Search Report and Written Opinion dated Oct. 11, 2021, in connection with International Application No. PCT/JP2021/032670.
PCT/JP2021/032670, Oct. 11, 2021, International Search Report and Written Opinion.

* cited by examiner

*Primary Examiner* — Peter F Godenschwager
(74) *Attorney, Agent, or Firm* — Wolf, Greenfield & Sacks, P.C.

(57) ABSTRACT

Disclosed is an elastic fiber treatment agent that contains a smoothing agent and an alkyl phosphate ester compound. The alkyl phosphate ester compound contains specific phosphate ester Q1 and at least one or more selected from specific phosphate esters Q2 and Q3. In a P nucleus NMR measurement of the alkyl phosphate ester compound upon an alkali over-neutralization pretreatment, a P nucleus NMR integral ratio attributed to the phosphate ester Q1 is 15% to 60% if the sum of P nucleus NMR integral ratios attributed to the phosphate esters Q1 to Q3 and phosphoric acid and its salt is taken as 100%.

11 Claims, No Drawings

TREATMENT AGENT FOR ELASTIC FIBERS, AND ELASTIC FIBER

CROSS REFERENCE TO RELATED APPLICATIONS

This Application is a national stage filing under 35 U.S.C. 371 of International Patent Application Serial No PCT/JP2021/032670, filed Sep. 6, 2021, which claims priority to Japanese application number 2020-149963 filed, Sep. 7, 2020. The entire contents of these applications are incorporated herein by reference in their entirety.

TECHNICAL FIELD

The present invention relates to an elastic fiber treatment agent that contains a smoothing agent and a specific alkyl phosphate ester compound and to an elastic fiber to which the elastic fiber treatment agent is adhered.

BACKGROUND ART

Elastic fibers, such as polyurethane elastic fibers, are strong in stickiness between the fibers in comparison to other synthetic fibers. Therefore, there is a problem in that when after elastic fibers are spun and wound into a package, the fibers are drawn out from the package to be subject to a processing step, it is difficult to unwind the fibers stably from the package. Thus, an elastic fiber treatment agent that contains a smoothing agent such as a hydrocarbon oil may be used to improve the smoothness of the elastic fibers.

An elastic fiber treatment agent as disclosed in Patent Document 1 is previously known. Patent Document 1 discloses an elastic fiber treatment agent that contains a hydrocarbon oil and at least one selected from an ester oil, a higher alcohol, a polyhydric alcohol, an organic phosphate ester, an organic amine, a metal soap, an organopolysiloxane resin, a nonionic surfactant, a cationic surfactant, and an anionic surfactant.

CITATION LIST

Patent Literature

Patent Document 1: Japanese Laid-Open Patent Publication No. 2017-110319

SUMMARY OF INVENTION

Technical Problem

However, the elastic fiber treatment agent has been required to have a further improved effect of reducing frictional fluctuation imparted to an elastic fiber.

A problem to be solved by the present invention is to provide an elastic fiber treatment agent that is capable of reducing frictional fluctuation of an elastic fiber and an elastic fiber to which the elastic fiber treatment agent is adhered.

Solution to Problem

As a result of performing research toward solving the above problem, the inventors of the present application have found that an elastic fiber treatment agent in which a smoothing agent and a specific alkyl phosphate ester compound are blended is suitable.

In order to solve the above problem and in accordance with one aspect of the present invention, an elastic fiber treatment agent is characterized by containing a smoothing agent and an alkyl phosphate ester compound. The alkyl phosphate ester compound contains a phosphate ester Q1 represented by the following formula (1) and at least one or more selected from the group consisting of a phosphate ester Q2 represented by the following formula (2) and a phosphate ester Q3 represented by the following formula (3). At least one of $M^1$ to $M^4$ in the following formulas (1) to (3) is an alkaline earth metal. In a P nucleus NMR measurement of the alkyl phosphate ester compound upon an alkali over-neutralization pretreatment, a P nucleus NMR integral ratio attributed to the phosphate ester Q1 is 15% to 60% if the sum of P nucleus NMR integral ratios attributed to the phosphate ester Q1, the phosphate ester Q2, the phosphate ester Q3, and phosphoric acid and its salt is taken as 100%.

[Chemical Formula 1]

(1)

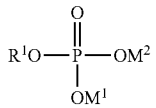

(In the formula (1), $R^1$ is an alkyl group with 4 to 24 carbon atoms, and $M^1$ and $M^2$ are each a hydrogen atom, an alkali metal, an alkaline earth metal, ammonium, phosphonium, or an organic amine salt.)

[Chemical Formula 2]

(2)

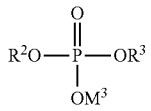

(In the formula (2), $R^2$ and $R^3$ are each an alkyl group with 4 to 24 carbon atoms, and $M^3$ is a hydrogen atom, an alkali metal, an alkaline earth metal, ammonium, phosphonium, or an organic amine salt.)

[Chemical Formula 3]

(3)

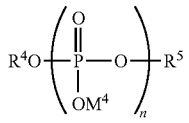

(In the formula (3), $R^4$ and $R^5$ are each an alkyl group with 4 to 24 carbon atoms, n is an integer of 2 or more, and $M^4$ is a hydrogen atom, an alkali metal, an alkaline earth metal, ammonium, phosphonium, or an organic amine salt, provided that when the number of $M^4$ present in the molecule is 2 or more, they may be identical with or different from each other.)

In the elastic fiber treatment agent, it is preferable that the alkyl phosphate ester compound contains the phosphate ester Q1 and the phosphate ester Q3 and has a P nucleus NMR integral ratio attributed to the phosphate ester Q3 of 5% to 50% if the sum of the P nucleus NMR integral ratios attributed to the phosphate ester Q1, the phosphate ester Q2, the phosphate ester Q3, and the phosphoric acid and its salt is taken as 100%.

In the elastic fiber treatment agent, it is preferable that the P nucleus NMR integral ratio attributed to the phosphate ester Q1 is 30% to 55% if the sum of the P nucleus NMR integral ratios attributed to the phosphate ester Q1, the phosphate ester Q2, the phosphate ester Q3, and the phosphoric acid and its salt is taken as 100%.

In the elastic fiber treatment agent, it is preferable that at least one of $M^1$ to $M^4$ in the formulas (1) to (3) is an alkali metal, ammonium, phosphonium, or an organic amine salt.

It is preferable that if the sum of the content ratios of the smoothing agent and the alkyl phosphate ester compound in the elastic fiber treatment agent is taken as 100 parts by mass, the content ratio of the alkyl phosphate ester compound in the elastic fiber treatment agent is 0.05 to 10 parts by mass.

The elastic fiber treatment agent preferably further contains a dialkyl sulfosuccinic acid salt.

It is preferable that if the sum of the content ratios of the smoothing agent, the alkyl phosphate ester compound, and the dialkyl sulfosuccinic acid salt in the elastic fiber treatment agent is taken as 100 parts by mass, the content ratio of the alkyl phosphate ester compound in the elastic fiber treatment agent is 0.05 to 10 parts by mass.

The elastic fiber treatment agent preferably further contains a higher alcohol.

In the elastic fiber treatment agent, the higher alcohol preferably includes Guerbet alcohols.

It is preferable that the elastic fiber treatment agent further contains a higher alcohol and that if the sum of the content ratios of the smoothing agent, the alkyl phosphate ester compound, the dialkyl sulfosuccinic acid salt, and the higher alcohol in the elastic fiber treatment agent is taken as 100 parts by mass, the content ratio of the alkyl phosphate ester compound in the elastic fiber treatment agent is 0.05 to 10 parts by mass.

In order to solve the above problem and in accordance with another aspect of the present invention, an elastic fiber is characterized in that the elastic fiber treatment agent is adhered thereto.

Advantageous Effects of Invention

The present invention succeeds in reducing frictional fluctuation of an elastic fiber.

DESCRIPTION OF EMBODIMENTS

First Embodiment

A first embodiment in which an elastic fiber treatment agent (referred to hereinafter as treatment agent) of the present invention is embodied will now be described. The treatment agent of the present embodiment contains a smoothing agent and a specific alkyl phosphate ester compound, and preferably further contains a dialkyl sulfosuccinic acid salt and/or a higher alcohol.

Examples of the smoothing agent to be used in the treatment agent of the present embodiment include silicone oils, mineral oils, polyolefins, and ester oils. The smoothing agent is blended in the treatment agent as a base component to impart smoothness to an elastic fiber.

The silicone oil is not particularly limited, and examples thereof include dimethyl silicone, phenyl-modified silicone, amino-modified silicone, amide-modified silicone, polyether-modified silicone, aminopolyether-modified silicone, alkyl-modified silicone, alkylaralkyl-modified silicone, alkylpolyether-modified silicone, ester-modified silicone, epoxy-modified silicone, carbinol-modified silicone, mercapto-modified silicone, and polyoxyalkylene-modified silicone. As the silicone oil, a commercially available product can be appropriately used.

Examples of the mineral oil include aromatic hydrocarbons, paraffinic hydrocarbons, and naphthenic hydrocarbons. More specific examples of the mineral oil include spindle oil and liquid paraffin. As the mineral oil, a commercially available product can be appropriately used.

As the polyolefin, a poly-α-olefin used as a smoothing component is used. Specific examples of the polyolefin include poly-α-olefins obtained by polymerizing, for example, 1-butene, 1-hexene, or 1-decene. As the poly-α-olefin, a commercially available product can be appropriately used.

The ester oil is not particularly limited, and examples thereof include ester oils produced from fatty acids and alcohols. The ester oil is, for example, an ester oil produced from a fatty acid having an odd or even number of hydrocarbon groups and an alcohol, which will be described later.

The fatty acid, which is a raw material for the ester oil, is not particularly limited in terms of, for example, the number of carbon atoms, presence or absence of branching, or valence, and may be, for example, a higher fatty acid, a fatty acid having a cyclo ring, or a fatty acid having an aromatic ring. The alcohol, which is a raw material for the ester oil, is not particularly limited in terms of, for example, the number of carbon atoms, presence or absence of branching, or valence, and may be, for example, a higher alcohol, an alcohol having a cyclo ring, or an alcohol having an aromatic ring.

Specific examples of the ester oil include (1) ester compounds of an aliphatic monoalcohol and an aliphatic monocarboxylic acid, such as octyl palmitate, oleyl laurate, oleyl oleate, isotridecyl stearate, and isotetracosyl oleate, (2) ester compounds of an aliphatic polyhydric alcohol and an aliphatic monocarboxylic acid, such as 1,6-hexanediol didecanate, glycerin trioleate, trimethylolpropane trilaurate, and pentaerythritol tetraoctanate, (3) ester compounds of an aliphatic monoalcohol and an aliphatic polycarboxylic acid, such as dioleyl azelate, dioleyl thiodipropionate, diisocetyl thiodipropionate, and diisostearyl thiodipropionate, (4) ester compounds of an aromatic monoalcohol and an aliphatic monocarboxylic acid, such as benzyl oleate and benzyl laurate, (5) complete ester compounds of an aromatic polyhydric alcohol and an aliphatic monocarboxylic acid, such as bisphenol A dilaurate, (6) complete ester compounds of an aliphatic monoalcohol and an aromatic polycarboxylic acid, such as bis2-ethylhexyl phthalate, diisostearyl isophthalate, and trioctyl trimellitate, and (7) natural fats and oils, such as coconut oil, rapeseed oil, sunflower oil, soybean oil, castor oil, sesame oil, fish oil, and beef tallow.

As the smoothing agent, one smoothing agent may be used alone, or two or more smoothing agents may be used in appropriate combination.

The alkyl phosphate ester compound to be used in the treatment agent of the present embodiment contains a phosphate ester Q1 represented by the following formula (1).

[Chemical Formula 4]

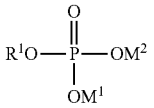

(1)

(In the formula (1), $R^1$ is an alkyl group with 4 to 24 carbon atoms or an alkenyl group with 4 to 24 carbon atoms, and $M^1$ and $M^2$ are each a hydrogen atom, an alkali metal, an alkaline earth metal, ammonium, phosphonium, or an organic amine salt.)

As the phosphate ester Q1, one phosphate ester Q1 may be used alone, or two or more phosphate esters Q1 may be used in appropriate combination.

The alkyl group forming $R^1$ may be a linear alkyl group or an alkyl group having a branched chain structure. The alkenyl group forming $R^1$ may be a linear alkenyl group or an alkenyl group having a branched chain structure. As the alkyl group or alkenyl group having a branched chain, either of an alkyl group or alkenyl group branched at an a-position or an alkyl group or alkenyl group branched at a β-position can be used.

Specific examples of the linear alkyl group forming $R^1$ include a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, an icosyl group, a docosyl group, a tricosyl group, and a tetracosyl group.

Specific examples of the alkyl group having a branched chain structure forming $R^1$ include an isobutyl group, an isopentyl group, an isohexyl group, an isoheptyl group, an isooctyl group, an isononyl group, an isodecyl group, an isoundecyl group, an isododecyl group, an isotridecyl group, an isotetradecyl group, an isopentadecyl group, an isohexadecyl group, an isoheptadecyl group, an isooctadecyl group, an isoicosyl group, an isodocosyl group, an isotricosyl group, and an isotetracosyl group.

Specific examples of the linear alkenyl group forming $R^1$ include a butenyl group, a pentenyl group, a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, an icosenyl group, a docosenyl group, a tricosenyl group, and a tetracosenyl group.

Specific examples of the alkenyl group having a branched chain structure forming $R^1$ include an isobutenyl group, an isopentenyl group, an isohexenyl group, an isoheptenyl group, an isoctenyl group, an isononenyl group, an isodecenyl group, an isoundecenyl group, an isododecenyl group, an isotridecenyl group, an isotetradecenyl group, an isopentadecenyl group, an isohexadecenyl group, an isoheptadecenyl group, an isooctadecenyl group, an isoicosenyl group, an isodocosenyl group, an isotricosenyl group, and an isotetracosenyl group.

$M^1$ and $M^2$ each represent a hydrogen atom, an alkali metal, an alkaline earth metal, ammonium, phosphonium, or an organic amine salt. Specific examples of the alkali metal include sodium, potassium, and lithium. Specific examples of the alkaline earth metal include magnesium and calcium.

Specific examples of the phosphonium include quaternary phosphoniums, such as tetramethylphosphonium, tetraethylphosphonium, tetrabutylphosphonium, tetraoctylphosphonium, dibutyldihexylphosphonium, trihexyltetradecylphosphonium, triethyloctylphosphonium, and triphenylmethylphosphonium.

Specific examples of the organic amine include (1) aliphatic amines, such as methylamine, dimethylamine, trimethylamine, ethylamine, diethylamine, triethylamine, N-N-diisopropylethylamine, butylamine, dibutylamine, 2-methylbutylamine, tributylamine, octylamine, laurylamine, and dimethyllaurylamine, (2) aromatic amines or heterocyclic amines, such as aniline, N-methylbenzylamine, pyridine, morpholine, piperazine, and derivatives thereof, (3) alkanolamines, such as monoethanolamine, N-methylethanolamine, diethanolamine, triethanolamine, isopropanolamine, diisopropanolamine, triisopropanolamine, dibutylethanolamine, butyldiethanolamine, octyldiethanolamine, and lauryldiethanolamine, (4) arylamines, such as N-methylbenzylamine, and (5) polyoxyalkylene alkylaminoethers, such as polyoxyethylene laurylaminoether and polyoxyethylene sterylaminoether.

The alkyl phosphate ester compound to be used in the treatment agent of the present embodiment contains at least one or more selected from the group consisting of a phosphate ester Q2 represented by the following formula (2) and a phosphate ester Q3 represented by the following formula (3).

[Chemical Formula 5]

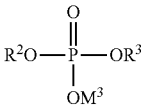

(2)

(In the formula (2), $R^2$ and $R^3$ are each an alkyl group with 4 to 24 carbon atoms or an alkenyl group with 4 to 24 carbon atoms, and $M^3$ is a hydrogen atom, an alkali metal, an alkaline earth metal, ammonium, phosphonium, or an organic amine salt.)

As the phosphate ester Q2, one phosphate ester Q2 may be used alone, or two or more phosphate esters Q2 may be used in appropriate combination.

The alkyl group forming $R^2$ or $R^3$ may be a linear alkyl group or an alkyl group having a branched chain structure. The alkenyl group forming $R^2$ or $R^3$ may be a linear alkenyl group or an alkenyl group having a branched chain structure. As the alkyl group or alkenyl group having a branched chain, either of an alkyl group or alkenyl group branched at an a-position or an alkyl group or alkenyl group branched at a β-position can be used.

Specific examples of the alkyl group forming $R^2$ or $R^3$ include those exemplified as the alkyl group forming $R^1$ of Formula (1). Specific examples of the alkenyl group forming $R^2$ or $R^3$ include those exemplified as the alkenyl group forming $R^1$ of Formula (1).

Specific examples of $M^3$ include those exemplified as $M^1$ or $M^2$ of Formula (1).

[Chemical Formula 6]

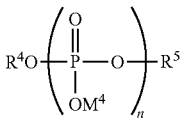

(3)

(In the formula (3), $R^4$ and $R^5$ are each an alkyl group with 4 to 24 carbon atoms or an alkenyl group with 4 to 24 carbon atoms, n is an integer of 2 or more, and $M^4$ is a hydrogen atom, an alkali metal, an alkaline earth metal, ammonium, phosphonium, or an organic amine salt, provided that when the number of $M^4$ present in the molecule is 2 or more, they may be identical with or different from each other.)

As the phosphate ester Q3, one phosphate ester Q3 may be used alone, or two or more phosphate esters Q3 may be used in appropriate combination.

The alkyl group forming $R^4$ or $R^5$ may be a linear alkyl group or an alkyl group having a branched chain structure. The alkenyl group forming $R^4$ or $R^5$ may be a linear alkenyl group or an alkenyl group having a branched chain structure. As the alkyl group or alkenyl group having a branched chain, either of an alkyl group or alkenyl group branched at an α-position or an alkyl group or alkenyl group branched at a β-position can be used.

Specific examples of the alkyl group forming $R^4$ or $R^5$ include those exemplified as the alkyl group forming $R^1$ of Formula (1). Specific examples of the alkenyl group forming $R^4$ or $R^5$ include those exemplified as the alkenyl group forming $R^1$ of Formula (1).

Specific examples of $M^4$ include those exemplified as $M^1$ or $M^2$ of Formula (1).

In the phosphate ester compound to be used in the treatment agent of the present embodiment, $R^1$ to $R^5$ in the above formulas (1) to (3) are each an alkyl group with 4 to 24 carbon atoms. With such a configuration, the effects of the present invention are further improved.

In the alkyl phosphate ester compound to be used in the treatment agent of the present embodiment, at least one of $M^1$ to $M^4$ in the above formulas (1) to (3) is preferably an alkali metal, an alkaline earth metal, ammonium, phosphonium, or an organic amine salt. With such a configuration, a cob webbing prevention property is improved.

In the alkyl phosphate ester compound to be used in the treatment agent of the present embodiment, at least one of $M^1$ to $M^4$ in the above formulas (1) to (3) is an alkaline earth metal. With such a configuration, an unwinding property is improved.

The alkyl phosphate ester compound to be used in the treatment agent according to the present embodiment has a P nucleus NMR integral ratio attributed to the phosphate ester Q1 of 15% to 60% if the sum of P nucleus NMR integral ratios attributed to the phosphate ester Q1, the phosphate ester Q2, the phosphate ester Q3, and phosphoric acid and its salt is taken as 100% in a P nucleus NMR measurement of the alkyl phosphate ester compound upon an alkali over-neutralization pretreatment.

The "alkali over-neutralization pretreatment" means a pretreatment in which an excess amount of alkali is added to the alkyl phosphate ester compound. Specific examples of the alkali are not particularly limited, and include organic amines and hydroxides of alkali metals or alkaline earth metals. The alkali may be identical with or different from the alkali used when an alkyl phosphate ester salt is synthesized. Specific examples of the organic amine include those exemplified as the organic amine forming the phosphate ester salt described above. Specific examples of the hydroxide of the alkali metal or alkaline earth metal include sodium hydroxide, potassium hydroxide, and magnesium hydroxide.

In $^{31}$P-NMR measurement, peaks attributed to the phosphate ester Q1, the phosphate ester Q2, the phosphate ester Q3, and the phosphoric acid and its salt can be clearly separated by performing this "alkali over-neutralization pretreatment," and it is possible to calculate the P nucleus integral ratio attributed to each compound based on the following mathematical formulas (1) to (4). In the measurement of $^{31}$P-NMR in the Examples which will be described later, an alkali over-neutralization treatment was performed in which an alkali enough to separate peaks to be observed was added to the alkyl phosphate ester compound.

The P nucleus NMR integral ratio attributed to the phosphate ester Q1 is represented by the following mathematical formula (1), the P nucleus NMR integral ratio attributed to the phosphate ester Q2 is represented by the following mathematical formula (2), the P nucleus NMR integral ratio attributed to the phosphate ester Q3 is represented by the following mathematical formula (3), and the P nucleus NMR integral ratio attributed to the phosphoric acid and its salt is represented by the following mathematical formula (4).

[Mathematical Formula 1]

$$Q1_P\%=\{Q1_P/(Q1_P+Q2_P+Q3_P+\text{Phosphoric acid}_P\}\times 100 \quad (1)$$

(In the mathematical formula (1),

Q1_P % is a P nucleus NMR integral ratio attributed to the phosphate ester Q1,

Q1_P is a P nucleus NMR integral value attributed to the phosphate ester Q1,

Q2_P is a P nucleus NMR integral value attributed to the phosphate ester Q2,

Q3_P is a P nucleus NMR integral value attributed to the phosphate ester Q3, and Phosphoric acid_P is a P nucleus NMR integrated value attributed to the phosphoric acid and its salt.)

[Mathematical Formula 2]

$$Q2_P\%=\{Q2_P/(Q1_P+Q2_P+Q3_P+\text{Phosphoric acid}_P)\}\times 100 \quad (2)$$

(In the mathematical formula (2),

Q2_P % is a P nucleus NMR integral ratio attributed to the phosphate ester Q2,

Q1_P is a P nucleus NMR integral value attributed to the phosphate ester Q1,

Q2_P is a P nucleus NMR integral value attributed to the phosphate ester Q2,

Q3_P is a P nucleus NMR integral value attributed to the phosphate ester Q3, and Phosphoric acid_P is a P nucleus NMR integrated value attributed to the phosphoric acid and its salt.

[Mathematical Formula 3]

$$Q3_P\%=\{Q3_P/(Q1_P+Q2_P+Q3_P+\text{Phosphoric acid}_P)\}\times 100 \quad (3)$$

(In the mathematical formula (3),

Q3_P % is a P nucleus NMR integral ratio attributed to the phosphate ester Q3,

Q1_P is a P nucleus NMR integral value attributed to the phosphate ester Q1,

Q2_P is a P nucleus NMR integral value attributed to the phosphate ester Q2,

Q3_P is a P nucleus NMR integral value attributed to the phosphate ester Q3, and Phosphoric acid_P is a P nucleus NMR integrated value attributed to the phosphoric acid and its salt.

[Mathematical Formula 4]

$$\text{Phosphoric acid_}P\%=\{\text{Phosphoric acid_}P/(Q1_P+Q2_P+Q3_P+\text{Phosphoric acid_}P)\}\times 100 \quad (4)$$

(In the mathematical formula (4),

Phosphoric acid_P % is a P nucleus NMR integral ratio attributed to the phosphoric acid and its salt, Q1_P is a P nucleus NMR integral value attributed to the phosphate ester Q1, Q2_P is a P nucleus NMR integral value attributed to the phosphate ester Q2, Q3_P is a P nucleus NMR integral value attributed to the phosphate ester Q3, Phosphoric acid_P is a P nucleus NMR integrated value attributed to the phosphoric acid and its salt.

It is preferable that the alkyl phosphate ester compound used in the treatment agent of the present embodiment contains the phosphate ester Q1 and the phosphate ester Q3 and has a P nucleus NMR integral ratio attributed to the phosphate ester Q3 of 5% to 50% if the sum of the P nucleus NMR integral ratios attributed to the phosphate ester Q1, the phosphate ester Q2, the phosphate ester Q3, and the phosphoric acid and its salt is taken as 100%. The P nucleus NMR integral ratio is defined in such a numerical range, so that the effects of the present invention are further improved.

The alkyl phosphate ester compound used in the treatment agent of the present embodiment preferably has a P nucleus NMR integral ratio attributed to the phosphate ester Q1 of 30% to 55% if the sum of the P nucleus NMR integral ratios attributed to the phosphate ester Q1, the phosphate ester Q2, the phosphate ester Q3, and the phosphoric acid and its salt is taken as 100%. The P nucleus NMR integral ratio is defined in such a numerical range, so that the frictional fluctuation of an elastic fiber is further reduced.

The alkyl phosphate ester compound to be used in the treatment agent of the present embodiment is obtained by reacting, for example, diphosphorus pentoxide with a saturated aliphatic alcohol or unsaturated aliphatic alcohol with 4 to 24 carbon atoms as a raw material alcohol to obtain an alkyl phosphate ester, and then neutralizing or over-neutralizing the alkyl phosphate ester with an alkali such as potassium hydroxide as necessary. In the case of the above-described synthesis method, the alkyl phosphate ester compound is usually a mixture of the phosphate ester Q1 represented by Chemical Formula 1, the phosphate ester Q2 represented by Chemical Formula 2, the phosphate ester Q3, and phosphoric acid or a phosphoric acid salt. The alkyl phosphate ester compound may be prepared by mixing the phosphoric ester Q1, the phosphoric ester Q2 represented by Chemical Formula 2, the phosphoric ester Q3, and phosphoric acid or a phosphoric acid salt, which have each been synthesized.

If the sum of the content ratios of the smoothing agent and the alkyl phosphate ester compound in the treatment agent of the present embodiment is taken as 100 parts by mass, the content ratio of the alkyl phosphate ester compound in the treatment agent is preferably 0.05 to 10 parts by mass. The P nucleus NMR integral ratio is defined in such a numerical range, so that the effects of the present invention are further improved.

The treatment agent of the present embodiment preferably contains a dialkyl sulfosuccinic acid salt. The dialkyl sulfosuccinic acid salt further improves an antistatic property. Specific examples of the dialkyl sulfosuccinic acid salt are not particularly limited, but those having an alkyl group with 8 to 16 carbon atoms are preferable. Examples of the salt include alkali metal salts, such as sodium salts and potassium salts, alkaline earth metal salts, ammonium salts, and organic amine salts, such as alkanolamine. Specific examples of the dialkyl sulfosuccinic acid salt include dioctyl sulfosuccinic acid sodium salt, dioctyl sulfosuccinic acid magnesium salt, dioctyl sulfosuccinic acid triethanolamine salt, didecyl sulfosuccinic acid sodium salt, didodecyl sulfosuccinic acid sodium salt (dilauryl sulfosuccinic acid sodium salt), didodecyl sulfosuccinic acid magnesium salt, ditetradecyl sulfosuccinic acid lithium salt, and dihexadecyl sulfosuccinic acid potassium salt. As the dialkyl sulfosuccinic acid salt, one dialkyl sulfosuccinic acid salt may be used alone, or two or more dialkyl sulfosuccinic acid salts may be used in appropriate combination.

If the sum of the content ratios of the smoothing agent, the alkyl phosphate ester compound, and the dialkyl sulfosuccinic acid salt in the treatment agent of the present embodiment is taken as 100 parts by mass, the content ratio of the alkyl phosphate ester compound in the treatment agent is preferably 0.05 to 10 parts by mass. The content ratio is defined in such a range, so that the effects of the present invention are further improved.

If the sum of the content ratios of the smoothing agent, the alkyl phosphate ester compound, and the dialkyl sulfosuccinic acid salt in the treatment agent of the present embodiment is taken as 100 parts by mass, the content ratio of the dialkyl sulfosuccinic acid salt in the treatment agent is preferably 0.05 to 10 parts by mass. The content ratio is defined in such a range, so that the antistatic property is further improved.

The treatment agent of the present embodiment preferably contains a higher alcohol. By blending such a higher alcohol, scum can be reduced.

The higher alcohol is a monohydric alcohol having a hydrocarbon group with 6 or more carbon atoms. The number of carbon atoms in the higher alcohol is preferably 6 or more, and more preferably 6 to 22. The higher alcohol is not particularly limited in terms of the presence or absence of an unsaturated bond, and may be an alcohol having a linear or branched hydrocarbon group, an alcohol having a cyclo ring, or an alcohol having an aromatic ring. In the case of an alcohol having a branched hydrocarbon group, the branching position is not particularly limited. For example, the hydrocarbon group may have a carbon chain branched at an a-position or a carbon chain branched at a β-position.

Among them, a Guerbet alcohol is preferable, and a Guerbet alcohol with 6 to 22 carbon atoms is more preferable. Specific examples of the Guerbet alcohol include 2-ethyl-1-propanol, 2-ethyl-1-butanol, 2-ethyl-1-hexanol, 2-ethyl-1-octanol, 2-ethyl-decanol, 2-butyl-1-hexanol, 2-butyl-1-octanol, 2-butyl-1-decanol, 2-hexyl-1-octanol, 2-hexyl-1-decanol, 2-octyl-1-decanol, 2-octyl-1-dodecanol, 2-hexyl-1-octanol, 2-hexyl-1-dodecanol, 2-(1,3,3-trimethylbutyl)-5,7,7-trimethyl-1-octanol, 2-(4-methylhexyl)-8-methyl-1-decanol, and 2-(1,5-dimethylhexyl)-5,9-dimethyl-1-decanol.

As the higher alcohol, one higher alcohol may be used alone, or two or more higher alcohols may be used in appropriate combination.

If the sum of the content ratios of the smoothing agent, the alkyl phosphate ester compound, the dialkyl sulfosuccinic acid salt, and the higher alcohol in the treatment agent of the present embodiment is taken as 100 parts by mass, the content ratio of the alkyl phosphate ester compound in the treatment agent is preferably 0.05 to 10 parts by mass. The content ratio is defined in such a range, so that the effects of the present invention are further improved.

If the sum of the content ratios of the smoothing agent, the alkyl phosphate ester compound, the dialkyl sulfosuccinic acid salt, and the higher alcohol in the treatment agent of the present embodiment is taken as 100 parts by mass, the content ratio of the higher alcohol in the treatment agent is preferably 0.05 to 10 parts by mass. The content ratio is defined in such a range, so that the scum reducing effect is further improved.

Second Embodiment

Next, a second embodiment in which an elastic fiber according to the present invention is embodied will be described. The treatment agent of the first embodiment is adhered to an elastic fiber of the present embodiment. The amount of the treatment agent (not containing a solvent) of the first embodiment adhered to the elastic fiber is not particularly limited, but the treatment agent is preferably adhered in a proportion of 0.1% to 10% by mass from the viewpoint of further improving the effects of the present invention.

The elastic fiber is not particularly limited, and examples thereof include polyester elastic fibers, polyamide elastic fibers, polyolefin elastic fibers, and polyurethane elastic fibers. Among them, polyurethane elastic fibers are preferable. In such a case, the effects of the present invention can be further exhibited more highly.

The method for producing the elastic fiber of the present embodiment includes feeding the treatment agent of the first embodiment to the elastic fiber. As a method for feeding the treatment agent, a method of adhering the treatment agent to the elastic fiber in a step of spinning the elastic fiber by a neat feeding method without diluting the treatment agent is preferable. As the adhering method, for example, a known method such as a roller lubrication method, a guide lubrication method, or a spray lubrication method can be used. A lubrication roller is generally located between a spinneret and a winding traverse, and can also be applied to the production method of the present embodiment. Among them, it is preferable to adhere the treatment agent of the first embodiment to an elastic fiber, for example, a polyurethane elastic fiber by a lubrication roller located between stretching rollers because the effects are remarkably exhibited.

The method for producing the elastic fiber itself applied to the present embodiment is not particularly limited, and the elastic fiber can be produced by a known method. Examples of the method include a wet spinning method, a melt spinning method, and a dry spinning method. Among them, the dry spinning method is preferable from the viewpoint of excellent quality and production efficiency of the elastic fiber.

The operation and effects of the treatment agent and the elastic fiber of the embodiments will be described.

(1) The treatment agent of the embodiment contains a smoothing agent and a specific alkyl phosphate ester compound. Therefore, frictional fluctuation of the elastic fiber to which the treatment agent is applied can be reduced. Thus, the tension caused by the abrasion between a travelling yarn and the roller, i.e., the frictional fluctuation, can be reduced at the time of processing, so that processability can be improved. For example, unevenness can be reduced at the time of producing a knitted fabric, a woven fabric, or the like.

(2) In addition, the antistatic property of the elastic fiber can be improved. In addition, the cob webbing prevention property and unwinding property after winding can be improved. In addition, scum can be reduced.

The above embodiments may be modified as follows. The above-described embodiments and the following modifications can be implemented in combination with each other, as long as there is no technical contradiction.

The treatment agent of the above embodiment may further contain a component usually used in a treatment agent, such as a stabilizer, an antistatic agent, a binder, an antioxidant, and an ultraviolet absorber for maintaining the quality of the treatment agent, as long as the effects of the present invention are not impaired.

EXAMPLES

Examples will now be given below to describe the features and effects of the present invention more specifically, but the present invention is not limited to these examples. In the following description of working examples and comparative examples, "parts" means parts by mass, and "%" means % by mass.

Experimental Part 1 (Synthesis of Alkyl Phosphate Ester Compound)

Alkyl phosphate ester compounds used in treatment agents of examples and comparative examples were synthesized by a method described below.

Synthesis of Alkyl Phosphate Ester Compound (A-1)

2-Ethylhexanol was used as a raw material alcohol, diphosphorus pentoxide was added thereto under stirring, and they were reacted at 70±5° C. for 3 hours. Next, equivalent neutralization was performed with magnesium hydroxide as a neutralizer, followed by dehydration at 100° C. under reduced pressure for 2 hours to synthesize an alkyl phosphate ester compound (A-1).

Synthesis of Alkyl Phosphate Ester Compounds (A-2 to A-7)

In the same manner as in the synthesis of the alkyl phosphate ester compound (A-1), equivalent neutralization and dehydration under reduced pressure were performed using the raw material alcohols and neutralizers shown in Table 1 to synthesize alkyl phosphate ester compounds (A-2 to A-7).

Synthesis of Alkyl Phosphate Ester Compound (A-8)

2-Ethylhexanol was used as a raw material alcohol, diphosphorus pentoxide was added thereto under stirring, and they were reacted at 70±5° C. for 3 hours to synthesize an alkyl phosphate ester compound (A-8).

Synthesis of Alkyl Phosphate Ester Compound (ra-1)

2-Ethylhexanol was used as a raw material alcohol, diphosphorus pentoxide and polyphosphoric acid were added thereto under stirring, and they were reacted at 70±5° C. for 3 hours. Next, equivalent neutralization was performed with magnesium hydroxide as a neutralizer, followed by dehydration at 100° C. under reduced pressure for 2 hours to synthesize an alkyl phosphate ester compound (ra-1).

Synthesis of Alkyl Phosphate Ester Compound (ra-2)

2-Decyltetradecanol was used as a raw material alcohol, diphosphorus pentoxide was added thereto under stirring, and they were reacted at 70±5° C. for 1 hour to synthesize an alkyl phosphate ester compound (ra-2).

The raw material alcohols which would form the alkyl groups of the alkyl phosphate ester compounds (A-1) to (A-8), (ra-1), and (ra-2) to be blended in the treatment agents, and the neutralizers (alkalis) for forming salts are shown in the "Raw material alcohol" column and the "Neutralizer" column of Table 1, respectively.

P nucleus NMR Measurement Method

Each of the alkyl phosphate ester compounds synthesized in the manner described above was pretreated with an excess amount of laurylamine as an alkali. By this pretreatment, peaks attributed to a phosphate ester Q1, a phosphate ester Q2, a phosphate ester Q3, and phosphoric acid and its salt can be clearly separated in the $^{31}$P-NMR measurement. Then, P nucleus integral values attributed to the phosphate esters Q1, Q2, and Q3 and phosphoric acid and its salt were each determined using $^{31}$P-NMR. As the P nucleus integral ratio, a measured value of $^{31}$P-NMR (trade name: MERCURY plus NMR Spectrometer System manufactured by VALIAN Corporation, 300 MHz) was used. As a solvent, deuterated chloroform was used. The respective P nucleus integral ratios (%) attributed to the phosphate esters Q1, Q2, and Q3 and phosphoric acid and its salt were determined based on the above-described mathematical formulas (1) to (4). The respective P nucleus integral ratios (%) of the phosphate esters Q1, Q2, and Q3 and phosphoric acid and its salt determined by the P nucleus NMR measurement of the alkyl phosphate ester compound are shown in the "P nucleus NMR measurement" column in Table 1.

TABLE 1

| | | | P nucleus NMR measurement | | | |
|---|---|---|---|---|---|---|
| Type | Raw material alcohol | Neutralizer | Q1 Integral ratio (%) | Q2 Integral ratio (%) | Q3 Integral ratio (%) | Phosphoric acid Integral ratio (%) |
| A-1 | 2-Ethylhexanol | Magnesium hydroxide | 49.2 | 41.5 | 8.1 | 1.2 |
| A-2 | 2-Decyltetradecanol | Magnesium hydroxide | 48.8 | 21 | 26.5 | 3.7 |
| A-3 | 2-Hexyldecanol | Magnesium hydroxide | 52.8 | 21 | 22.5 | 3.7 |
| A-4 | 2-Butyloctanol | Magnesium hydroxide | 33.4 | 45.2 | 18.9 | 2.5 |
| A-5 | 2,6-Dimethyl-4 heptanol | Magnesium hydroxide | 19.4 | 38.3 | 40.7 | 1.6 |
| A-6 | 2-Ethylhexanol | dibutylethanolamine | 49.2 | 41.5 | 8.1 | 1.2 |
| A-7 | Oleyl alcohol | Potassium hydroxide | 32 | 30.2 | 37.1 | 0.7 |
| A-8 | 2-Ethylhexanol | None | 49.2 | 41.5 | 8.1 | 1.2 |
| ra-1 | 2-Ethylhexanol | Magnesium hydroxide | 81.3 | 9.8 | 0.1 | 8.8 |
| ra-2 | 2-Decyltetradecanol | None | 12.7 | 39.9 | 41.4 | 6 |

Experimental Part 2 (Preparation of Elastic Fiber Treatment Agent)

Treatment agents used in examples and the comparative examples were prepared by the following preparation method using the components shown in Tables 1 and 2. Forty eight (48) parts (%) of dimethyl silicone (D-1) having a viscosity of 10 cst at 25° C. and 48 parts (%) of mineral oil (D-2) having a viscosity of 60 seconds as measured with a Redwood viscometer at 40° C. were well mixed with 2 parts (%) of an alkyl phosphate ester compound (A-1), 1 part (%) of a dilauryl sulfosuccinate sodium salt (B-1), and 1 part (%) of 2-hexyl-1-decanol (C-1) shown in Table 1 to make a uniform mixture, thereby preparing a treatment agent of Example 1.

In Examples 2 to 18 and 22 to 25, Reference Examples 19 to 21 and 26, and Comparative Examples 1 to 3, a smoothing agent, an alkyl phosphate ester compound, a dialkyl sulfosuccinate ester salt, and a higher alcohol were mixed in the same manner as in Example 1 in the proportions shown in Table 2 to prepare treatment agents.

The types of the components, i.e., smoothing agent, alkyl phosphate ester compound, dialkyl sulfosuccinate ester salt, and higher alcohol in each of the treatment agents, and the content ratios of the respective components if the sum of the content ratios of the respective components is 100% are shown in the "smoothing agent," "alkyl phosphate ester compound," "dialkyl sulfosuccinate ester salt," and "higher alcohol" columns in Table 2, respectively.

TABLE 2

| | Elastic fiber treatment agent | | | | | | | | Evaluation | | | | |
|---|---|---|---|---|---|---|---|---|---|---|---|---|---|
| | Smoothing agent | | Alkyl phosphate ester compound | | Dialkyl sulfosuccinate ester salt | | Higher alcohol | | | | | | |
| Section | Type | Ratio (%) | Type | Ratio (%) | Type | Ratio (%) | Type | Ratio (%) | Leakage resistance | Cob webbing prevention property | Frictional fluctuation | Unwinding property | Scum |
| Example 1 | D-1<br>D-2 | 48<br>48 | A-1 | 2 | B-1 | 1 | C-1 | 1 | ○○ | ○○ | ○○ | ○○ | ○○ |
| Example 2 | D-1<br>D-3 | 48<br>48 | A-1 | 2 | B-1 | 1 | C-1 | 1 | ○○ | ○○ | ○○ | ○○ | ○○ |
| Example 3 | D-1<br>D-2 | 49.8<br>48 | A-1 | 0.2 | B-1 | 1 | C-1 | 1 | ○○ | ○○ | ○○ | ○○ | ○○ |
| Example 4 | D-1<br>D-2 | 46<br>45 | A-1 | 7 | B-1 | 1 | C-1 | 1 | ○○ | ○○ | ○○ | ○○ | ○○ |
| Example 5 | D-1<br>D-2 | 47<br>46 | A-1 | 5 | B-1 | 1 | C-1 | 1 | ○○ | ○○ | ○○ | ○○ | ○○ |
| Example 6 | D-1<br>D-2 | 48.8<br>48 | A-1 | 2 | B-1 | 0.2 | C-1 | 1 | ○○ | ○○ | ○○ | ○○ | ○○ |
| Example 7 | D-1<br>D-2 | 45<br>45 | A-1 | 2 | B-1 | 7 | C-1 | 1 | ○○ | ○○ | ○○ | ○○ | ○○ |
| Example 8 | D-1<br>D-2 | 48.8<br>48 | A-1 | 2 | B-1 | 1 | C-1 | 0.2 | ○○ | ○○ | ○○ | ○○ | ○○ |
| Example 9 | D-1<br>D-2 | 45<br>44 | A-1 | 2 | B-1 | 1 | C-1 | 8 | ○○ | ○○ | ○○ | ○○ | ○○ |
| Example 10 | D-1<br>D-2 | 41<br>40 | A-1 | 6 | B-1 | 6 | C-1 | 7 | ○○ | ○○ | ○○ | ○○ | ○○ |
| Example 11 | D-1<br>D-2 | 49<br>48.5 | A-1 | 0.5 | B-1 | 0.5 | C-1 | 0.5 | ○○ | ○○ | ○○ | ○○ | ○○ |
| Example 12 | D-1<br>D-2 | 48<br>48 | A-1 | 2 | B-2 | 1 | C-1 | 1 | ○○ | ○○ | ○○ | ○○ | ○○ |
| Example 13 | D-1<br>D-2 | 48<br>48 | A-1 | 2 | B-1 | 1 | C-2 | 1 | ○○ | ○○ | ○○ | ○○ | ○○ |
| Example 14 | D-1<br>D-2 | 48<br>48 | A-2 | 2 | B-1 | 1 | C-2 | 1 | ○○ | ○○ | ○○ | ○○ | ○○ |
| Example 15 | D-1<br>D-2 | 48<br>48 | A-3 | 2 | B-1 | 1 | C-1 | 1 | ○○ | ○○ | ○○ | ○○ | ○○ |
| Example 16 | D-1<br>D-2 | 48<br>48 | A-4 | 2 | B-1 | 1 | C-1 | 1 | ○○ | ○○ | ○○ | ○○ | ○○ |
| Example 17 | D-1<br>D-2 | 48<br>48 | A-5 | 2 | B-1 | 1 | C-1 | 1 | ○○ | ○○ | ○ | ○○ | ○○ |
| Example 18 | D-1<br>D-2 | 49<br>48 | A-1 | 2 | B-1 | 1 | | | ○○ | ○○ | ○○ | ○○ | ○ |
| Reference Example 19 | D-1<br>D-2 | 48<br>48 | A-6 | 2 | B-1 | 1 | C-1 | 1 | ○○ | ○○ | ○○ | ○ | ○○ |
| Reference Example 20 | D-1<br>D-2 | 48<br>48 | A-7 | 2 | B-1 | 1 | C-1 | 1 | ○○ | ○○ | ○○ | ○ | ○○ |
| Reference Example 21 | D-1<br>D-2 | 48<br>48 | A-8 | 2 | B-1 | 1 | C-1 | 1 | ○○ | ○ | ○○ | ○ | ○○ |
| Example 22 | D-1<br>D-2 | 49<br>48 | A-1 | 2 | | | C-1 | 1 | ○ | ○○ | ○○ | ○○ | ○○ |
| Example 23 | D-1<br>D-2 | 49<br>48 | A-1 | 2 | | | C-1 | 1 | ○ | ○○ | ○○ | ○○ | ○○ |
| Example 24 | D-1<br>D-2 | 49<br>49 | A-1 | 2 | | | | | ○ | ○○ | ○○ | ○○ | ○ |
| Example 25 | D-1<br>D-2 | 49<br>48 | A-4 | 2 | | | C-1 | 1 | ○ | ○○ | ○ | ○○ | ○○ |
| Reference Example 26 | D-1<br>D-2 | 49<br>49 | A-7 | 2 | | | | | ○ | ○ | ○○ | ○ | ○ |
| Comparative Example 1 | D-1<br>D-2 | 49<br>49 | ra-1 | 2 | | | | | x | ○ | x | ○ | x |
| Comparative Example 2 | D-1<br>D-2 | 48<br>48 | ra-2 | 2 | B-1 | 1 | C-1 | 1 | ○ | x | x | x | ○ |
| Comparative Example 3 | D-1<br>D-2 | 49<br>49 | ra-2 | 2 | | | | | x | x | x | x | x |

Details of B-1 and -2, C-1 and -2, and D-1 to -3 indicated in Table 2 are as follows.

B-1: dilauryl sulfosuccinate sodium salt

B-2: dioctyl sulfosuccinate magnesium salt

C-1: 2-hexyl-1-decanol

C-2: 2-(1,3,3-trimethylbutyl)-5,7,7-trimethyl-1-octanol

D-1: dimethyl silicone having a viscosity of 10 cst ($mm^2/s$) at 25° C.

D-2: mineral oil having a viscosity of 60 seconds as measured with a Redwood viscometer at 40° C.

D-3: isotridecyl stearate

Experimental Part 3 (Production of Elastic Fiber)

A prepolymer obtained from polytetramethylene glycol having a molecular weight of 1,000 and diphenylmethane diisocyanate was subjected to a chain extension reaction with ethylenediamine in a dimethylformamide solution to obtain a spinning dope having a concentration of 30%. This spinning dope was dry-spun from a spinneret in a heated gas stream. Then, the treatment agent was neat-fed to the dry-spun polyurethane elastic fiber by a roller lubrication method using a lubrication roller located between stretching rollers before winding. The elastic fiber to which the treatment agent was fed with the roller as described above was wound around a cylindrical paper tube having a length of 58 mm at a winding speed of 600 m/min via a traverse guide giving a winding width of 38 mm using a winding machine of a surface drive to obtain 500 g of a package of 40 denier dry-spun polyurethane elastic fiber. The amount of the elastic fiber treatment agent adhered was adjusted to 5% by adjusting the rotation speed of the lubrication roller.

The package of dry-spun polyurethane elastic fiber thus obtained was used to evaluate the leakage resistance as the antistatic property of the elastic fiber, the cob webbing prevention property, the reduction in frictional fluctuation, the unwinding property, and the scum. The results are shown in the "leakage resistance," "cob webbing prevention property," "frictional fluctuation," "unwinding property," and "scum" columns in Table 2.

Experimental Part 4 (Evaluation of Elastic Fiber Treatment Agent and Elastic Fiber)

Evaluation of Leakage Resistance

The electrical resistance value of 5 g of the obtained dry-spun polyurethane elastic fiber immediately after spinning was measured under an atmosphere of 25° C.×40% RH using an electrical resistance measuring device (SM-5E type manufactured by Toa Electronics Ltd.), and the measured value was evaluated according to the following criteria.

- ○○ (good): The electrical resistance value is less than $1.0\times10^{8}\Omega$
- ○ (fair): The electrical resistance value is $1.0\times10^{8}\Omega$ or more and less than $1.0\times10^{9}\Omega$.
- x (poor): The electrical resistance value is $1.0\times10^{9}\Omega$ or more.

Evaluation of Cob Webbing Prevention Property

The number of times of yarn breakage due to the cob webbing of the obtained dry-spun polyurethane elastic fiber package (500 g winding) immediately after spinning, when the package was wound for 1,000 m at a delivery speed of 20 m/min and a winding speed of 40 m/min, was evaluated according to the following criteria.

- ○○ (good): The number of times of yarn breakage due to cob webbing is 0.
- ○ (fair): The number of times of yarn breakage due to cob webbing is 1 or more and less than 3.
- x (poor): The number of times of yarn breakage due to cob webbing is 3 or more.

Reduction in Frictional Fluctuation

A friction measuring meter (SAMPLE FRICTION UNIT MODEL TB-1 manufactured by EIKO SOKKI. Inc) was used, a chromium-plated satin pin having a diameter of 1 cm and a surface roughness of 2 S was disposed between two free rollers, and a contact angle of the polyurethane elastic fiber drawn out from each package (500 g winding) obtained in Experimental Part 3 with respect to the chromium-plated satin pin was set to 90 degrees. Under the conditions of 25° C. and 60% RH, an initial tension ($T_1$) of 5 g was applied on an entrance side, and a secondary tension ($T_2$) on an exit side when the yarn was made to travel at a speed of 100 m/min was measured every 1 second for 120 minutes. At this time, the difference between an average friction coefficient from 1 minute to 2 minutes after the start of the measurement and an average friction coefficient from 119 minutes to 120 minutes after the start of the measurement was obtained based on the following mathematical formula 5, and evaluated according to the following criteria.

$$\text{Difference in friction coefficient}=(2/3.14)\times 1n(T_{2E}/T_{1E})-(2/3.14)\times 1n(T_{2S}/T_{1S}) \quad \text{[Mathematical Formula 5]}$$

- $T_{1S}$: average value of $T_1$ tension from 1 minute to 2 minutes after the start of the measurement
- $T_{2S}$: average value of $T_2$ tension from 1 minute to 2 minutes after the start of the measurement
- $T_{1E}$: average value of $T_1$ tension from 119 minutes to 120 minutes after the start of the measurement
- $T_{2E}$: average value of $T_2$ tension from 119 minutes to 120 minutes after the start of the measurement Criteria for Evaluation of Frictional Fluctuation

- ○○ (good): The difference in friction coefficient is less than 0.07.
- ○ (fair): The difference in friction coefficient is 0.07 or more and less than 0.1.
- x (poor): The difference in friction coefficient is 0.1 or more.

Evaluation of Unwinding Property

A first driving roller and a first free roller always in contact with the first driving roller formed a delivery portion on one side, and a second driving roller and a second free roller always in contact with the second driving roller formed a winding portion on the opposite side. The winding portion was disposed so as to be separated from the delivery portion by 20 cm in the horizontal direction. The obtained dry-spun polyurethane elastic fiber package immediately after spinning was mounted onto the first driving roller, unwound until the thickness of the yarn winding reached 2 mm, and wound around the second driving roller. While the delivery speed of the polyurethane elastic fiber from the first driving roller was fixed at 50 m/min, the winding speed of the polyurethane elastic fiber to the second driving roller was gradually increased from 50 m/min to forcibly unwind the polyurethane elastic fiber from the package. In the forced unwinding, the winding speed V (m/min) at the time when the polyurethane elastic fiber was no longer disarrayed between the delivery portion and the wound portion was measured. The unwinding property (%) was determined based on the following formula and evaluated according to the following criteria.

$$\text{Unwinding property (\%)}=(V-50)\times 2$$

- ○○ (good): The unwinding property is less than 120% (unwinding can be stably performed without any problem).
- ○ (fair): The unwinding property is 120% or more and less than 180% (although there is a slight resistance to pulling out the yarn, no yarn breakage occurs, and unwinding can be stably performed).
- x (poor): The unwinding property is 180% or more (there is resistance to pulling out the yarn, yarn breakage occurs, and there is a problem in operation).

Evaluation of Scum

Ten (10) dry-spun polyurethane elastic fiber packages immediately after spinning were set in a miniature warping machine, and wound for 1,500 km at a yarn speed of 300 m/min under an atmosphere of 65% RH at 25° C. At this time, the falling off and accumulation of scum in a comb guide of the miniature warping machine were visually observed and evaluated according to the following criteria.

○○ (good): Scum was hardly attached.

○ (fair): Scum was slightly attached, but there was no problem in stable travelling of the yarn.

x (poor): Scum was considerably attached and accumulated, and there was a great problem in stable travelling of the yarn.

As is apparent from the evaluation results of the respective examples relative to the respective comparative examples in Table 2, the treatment agent of the present invention can improve the antistatic property, cob webbing prevention property, and unwinding property of the elastic fiber to which the treatment agent is applied. In addition, the frictional fluctuation and scum can be reduced.

The present invention also encompasses the following embodiments.

Additional Embodiment 1

An elastic fiber treatment agent comprising a smoothing agent and an alkyl phosphate ester compound, wherein the alkyl phosphate ester compound contains a phosphate ester Q1 represented by the following formula (1) and at least one or more selected from the group consisting of a phosphate ester Q2 represented by the following formula (2) and a phosphate ester Q3 represented by the following formula (3), and in a P nucleus NMR measurement of the alkyl phosphate ester compound upon an alkali over-neutralization pretreatment, a P nucleus NMR integral ratio attributed to the phosphate ester Q1 is 15% to 60% if the sum of P nucleus NMR integral ratios attributed to the phosphate ester Q1, the phosphate ester Q2, the phosphate ester Q3, and phosphoric acid and its salt is taken as 100%.

[Chemical Formula 7]

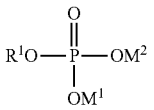

(1)

(In the formula (1), $R^1$ is an alkyl group with 4 to 24 carbon atoms or an alkenyl group with 4 to 24 carbon atoms, and $M^1$ and $M^2$ are each a hydrogen atom, an alkali metal, an alkaline earth metal, ammonium, phosphonium, or an organic amine salt.)

[Chemical Formula 8]

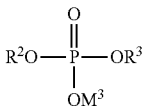

(2)

(In the formula (2), $R^2$ and $R^3$ are each an alkyl group with 4 to 24 carbon atoms or an alkenyl group with 4 to 24 carbon atoms, and $M^3$ is a hydrogen atom, an alkali metal, an alkaline earth metal, ammonium, phosphonium, or an organic amine salt.)

[Chemical Formula 9]

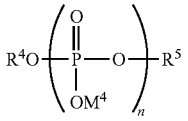

(3)

(In the formula (3), $R^4$ and $R^5$ are each an alkyl group with 4 to 24 carbon atoms or an alkenyl group with 4 to 24 carbon atoms, n is an integer of 2 or more, and $M^4$ is a hydrogen atom, an alkali metal, an alkaline earth metal, ammonium, phosphonium, or an organic amine salt, provided that when the number of $M^4$ present in the molecule is 2 or more, they may be identical with or different from each other.)

Additional Embodiment 2

The elastic fiber treatment agent according to additional embodiment 1, wherein the alkyl phosphate ester compound contains the phosphate ester Q1 and the phosphate ester Q3 and has a P nucleus NMR integral ratio attributed to the phosphate ester Q3 of 5% to 50% if the sum of the P nucleus NMR integral ratios attributed to the phosphate ester Q1, the phosphate ester Q2, the phosphate ester Q3, and the phosphoric acid and its salt is taken as 100%.

Additional Embodiment 3

The elastic fiber treatment agent according to additional embodiment 1 or 2, wherein the P nucleus NMR integral ratio attributed to the phosphate ester Q1 is 30% to 55% if the sum of the P nucleus NMR integral ratios attributed to the phosphate ester Q1, the phosphate ester Q2, the phosphate ester Q3, and the phosphoric acid and its salt is taken as 100%.

Additional Embodiment 4

The elastic fiber treatment agent according to any one of additional embodiments 1 to 3, wherein $R^1$ to $R^5$ in the formulas (1) to (3) are each an alkyl group with 4 to 24 carbon atoms.

Additional Embodiment 5

The elastic fiber treatment agent according to any one of additional embodiments 1 to 4, wherein at least one of $M^1$ to $M^4$ in the formulas (1) to (3) is an alkali metal, an alkaline earth metal, ammonium, phosphonium, or an organic amine salt.

Additional Embodiment 6

The elastic fiber treatment agent according to any one of additional embodiments 1 to 5, wherein the at least one of $M^1$ to $M^4$ in the formulas (1) to (3) is an alkaline earth metal.

Additional Embodiment 7

The elastic fiber treatment agent according to any one of additional embodiments 1 to 6, wherein if the sum of the content ratios of the smoothing agent and the alkyl phosphate ester compound in the elastic fiber treatment agent is taken as 100 parts by mass, the content ratio of the alkyl phosphate ester compound in the elastic fiber treatment agent is 0.05 to 10 parts by mass.

Additional Embodiment 8

The elastic fiber treatment agent according to any one of additional embodiments 1 to 7, further comprising a dialkyl sulfosuccinic acid salt.

Additional Embodiment 9

The elastic fiber treatment agent according to additional embodiment 8, wherein if the sum of the content ratios of the smoothing agent, the alkyl phosphate ester compound, and the dialkyl sulfosuccinic acid salt in the elastic fiber treatment agent is taken as 100 parts by mass, the content ratio of the alkyl phosphate ester compound in the elastic fiber treatment agent is 0.05 to 10 parts by mass.

Additional Embodiment 10

The elastic fiber treatment agent according to any one of additional embodiments 1 to 9, further comprising a higher alcohol.

Additional Embodiment 11

The elastic fiber treatment agent according to additional embodiment 10, wherein the higher alcohol includes a Guerbet alcohol.

Additional Embodiment 12

The elastic fiber treatment agent according to additional embodiment 8 or 9, further comprising a higher alcohol, wherein if the sum of the content ratios of the smoothing agent, the alkyl phosphate ester compound, the dialkyl sulfosuccinic acid salt, and the higher alcohol in the elastic fiber treatment agent is taken as 100 parts by mass, the content ratio of the alkyl phosphate ester compound in the elastic fiber treatment agent is 0.05 to 10 parts by mass.

Additional Embodiment 13

An elastic fiber to which the elastic fiber treatment agent according to any one of additional embodiments 1 to 12 is adhered.

The invention claimed is:

1. An elastic fiber treatment agent comprising a smoothing agent and an alkyl phosphate ester compound, wherein the alkyl phosphate ester compound contains a phosphate ester Q1 represented by the following formula (1) and at least one or more selected from the group consisting of a phosphate ester Q2 represented by the following formula (2) and a phosphate ester Q3 represented by the following formula (3), at least one of $M^1$ to $M^4$ in the following formulas (1) to (3) is an alkaline earth metal, and in a P nucleus NMR measurement of the alkyl phosphate ester compound upon an alkali over-neutralization pretreatment, a P nucleus NMR integral ratio attributed to the phosphate ester Q1 is 15% to 60% if the sum of P nucleus NMR integral ratios attributed to the phosphate ester Q1, the phosphate ester Q2, the phosphate ester Q3, and phosphoric acid and its salt is taken as 100%, (1)

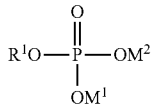

In the formula (1), $R^1$ is an alkyl group with 4 to 24 carbon atoms, and $M^1$ and $M^2$ are each a hydrogen atom, an alkali metal, an alkaline earth metal, ammonium, phosphonium, or an organic amine salt;

(2)

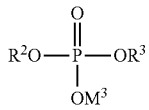

In the formula (2), $R^2$ and $R^3$ are each an alkyl group with 4 to 24 carbon atoms, and $M^3$ is a hydrogen atom, an alkali metal, an alkaline earth metal, ammonium, phosphonium, or an organic amine salt;

(3)

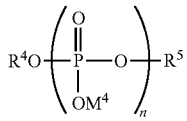

In the formula (3), $R^4$ and $R^5$ are each an alkyl group with 4 to 24 carbon atoms, n is an integer of 2 or more, and $M^4$ is a hydrogen atom, an alkali metal, an alkaline earth metal, ammonium, phosphonium, or an organic amine salt, provided that when the number of $M^4$ present in the molecule is 2 or more, they may be identical with or different from each other.

2. The elastic fiber treatment agent according to claim 1, wherein the alkyl phosphate ester compound contains the phosphate ester Q1 and the phosphate ester Q3 and has a P nucleus NMR integral ratio attributed to the phosphate ester Q3 of 5% to 50% if the sum of the P nucleus NMR integral ratios attributed to the phosphate ester Q1, the phosphate ester Q2, the phosphate ester Q3, and the phosphoric acid and its salt is taken as 100%.

3. The elastic fiber treatment agent according to according to claim 1, wherein the P nucleus NMR integral ratio attributed to the phosphate ester Q1 is 30% to 55% if the sum of the P nucleus NMR integral ratios attributed to the phosphate ester Q1, the phosphate ester Q2, the phosphate ester Q3, and the phosphoric acid and its salt is taken as 100%.

4. The elastic fiber treatment agent according to claim 1, wherein at least one of $M^1$ to $M^4$ in the formulas (1) to (3) is an alkali metal, ammonium, phosphonium, or an organic amine salt.

5. The elastic fiber treatment agent according to claim 1, wherein if the sum of the content ratios of the smoothing agent and the alkyl phosphate ester compound in the elastic fiber treatment agent is taken as 100 parts by mass, the content ratio of the alkyl phosphate ester compound in the elastic fiber treatment agent is 0.05 to 10 parts by mass.

6. The elastic fiber treatment agent according to claim 1, further comprising a dialkyl sulfosuccinic acid salt.

7. The elastic fiber treatment agent according to claim 6, wherein if the sum of the content ratios of the smoothing agent, the alkyl phosphate ester compound, and the dialkyl sulfosuccinic acid salt in the elastic fiber treatment agent is taken as 100 parts by mass, the content ratio of the alkyl phosphate ester compound in the elastic fiber treatment agent is 0.05 to 10 parts by mass.

8. The elastic fiber treatment agent according to claim 6, further comprising a higher alcohol, wherein if the sum of the content ratios of the smoothing agent, the alkyl phosphate ester compound, the dialkyl sulfosuccinic acid salt, and the higher alcohol in the elastic fiber treatment agent is taken as 100 parts by mass, the content ratio of the alkyl phosphate ester compound in the elastic fiber treatment agent is 0.05 to 10 parts by mass.

9. The elastic fiber treatment agent according to claim 1, further comprising a higher alcohol.

10. The elastic fiber treatment agent according to claim 9, wherein the higher alcohol includes a Guerbet alcohol.

11. An elastic fiber to which the elastic fiber treatment agent according to claim 1 is adhered.

* * * * *